United States Patent [19]

Stallings

[11] 4,298,470

[45] Nov. 3, 1981

[54] SEWAGE SEPTIC SYSTEM WITH LIQUID FLOW DRAINAGE CONTROL

[76] Inventor: Billy G. Stallings, 3 Crescent Dr., Kinston, N.C. 28501

[21] Appl. No.: 152,395

[22] Filed: May 22, 1980

[51] Int. Cl.[3] ..... E03F 11/00

[52] U.S. Cl. ..... 210/170; 210/532.2; 138/45; 137/577; 285/178

[58] Field of Search ..... 210/532.2, 170, 747, 210/100; 138/96 T, 96 R, 40, 45, 46; 137/577, 577.5; 251/345, 350, 352; 285/178

[56] References Cited

U.S. PATENT DOCUMENTS

| | | | |
|---|---|---|---|
| 278,723 | 6/1883 | Monteath | 285/178 |
| 360,168 | 3/1887 | McMahon | 285/178 |
| 1,248,058 | 11/1917 | Bailey | 138/40 |
| 1,304,979 | 5/1919 | Hirshstein | 285/177 |
| 1,473,439 | 11/1923 | Marsh | 285/155 |
| 1,584,313 | 5/1926 | Mallory | 138/96 I |
| 2,249,469 | 7/1941 | Gray et al. | 138/40 |
| 2,284,007 | 5/1942 | Metzdorf | 137/122 |
| 2,547,567 | 4/1951 | Collison | 285/183 |
| 2,782,604 | 2/1957 | Mixon | 210/532.2 |
| 2,891,574 | 6/1959 | Dahlberg | 137/577 |
| 2,921,681 | 1/1960 | Toulmin, Jr. | 210/71 |
| 3,371,679 | 3/1968 | Minella | 137/328 |
| 3,904,524 | 9/1975 | Pelton et al. | 210/532.2 |
| 3,956,137 | 5/1976 | Dempsey | 210/532.2 |
| 4,042,497 | 8/1977 | Maltby | 210/532.2 |
| 4,154,685 | 5/1979 | Marcotte | 210/532.2 |

FOREIGN PATENT DOCUMENTS

| | | | |
|---|---|---|---|
| 544656 | 2/1956 | Belgium | 138/96 R |

*Primary Examiner*—Benoit Castel

[57] ABSTRACT

A sewage septic tank system including a septic tank for receiving sewage discharge, a liquid junction box operatively connected to receive liquid discharge from the septic tank, at least one, and preferably a plurality of drainage lines opening into the liquid junction box for discharge and draining of liquid therefrom to a drain field and the like, and levelling caps having eccentrically disposed face openings therein, the caps being adjustably mounted on the liquid inlet ends of the drainage lines whereby the openings can be adjusted to provide for varied and different liquid levels in the junction box, and for controllable substantially even distribution of liquid into the drainage lines.

4 Claims, 7 Drawing Figures

SEWAGE SEPTIC SYSTEM WITH LIQUID FLOW DRAINAGE CONTROL

BACKGROUND OF THE INVENTION

This invention relates generally to sewage or waste disposal systems where liquid waste material is absorbed by soil at the site.

Septic sewage systems presently in use have been found under some circumstances and conditions, structurally and/or environmentally, to be lacking in optimum operation. While such known systems can operate to dispose of sewage under most circumstances, variations in installation and operating conditions can detract from optimum desired operation or functioning.

The normal septic systems currently in use include, as components thereof, a septic tank connected to receive sewage from a sewage disposal location such as toilets and the like, and inclusive of solid and liquid materials. The sewage disposed or discharged into the septic tank results, normally, in settlement of the heavier solid materials in the septic tank with the materials undergoing treatments such as aerobic and bacterial disintegration, and other treatment. The liquid separated from the sewage material in the septic tank is normally discharged as a partially clarified liquid in the nature of water into subsequent treatment containers including, for example, distribution or junction boxes, and this water or liquid is then discharged from the distribution or junction box by means by pipes or conduits to drain fields, either directly or into piping lines and systems in the drain fields.

Under some circumstances of installation and/or operation, the disposition of the entry ends of the drain lines from the junction boxes are so varied, and/or otherwise disturbed, as to result in uneven distribution of liquid into the drain lines, and in some installations the drain like entry ends are incapable of a desirable ready adjustment for different water levels and conditions in the junction or distribution box.

Geographical or terrain locations of septic systems can sometimes result in an unequal distribution of fluid or water from the junction box to a drain field in which located, and/or the geological formations are such that an unequal absorption and dissemination of the drainage liquid can occur.

SUMMARY OF THE INVENTION

It is accordingly a primary object of the present invention to provide a sewage septic tank system which will accommodate and/or overcome difficulties and drawbacks in function and operation inherent in some prior installations, and effectively provide means for equalizing drainage of liquid from a septic system for optimum drainage field dissemination.

In accordance with the teachings of the invention, a preferred construction includes the utilization of a liquid junction box operatively connected to receive liquid discharged from a septic tank, and a plurality of drainage lines or conduits opening into the liquid junction box for discharge and draining of liquid therefrom to a drain field. Liquid levelling caps are adjustably mounted on the liquid inlet ends of the drainage lines entering into the liquid junction box. These liquid levelling caps have openings in the end faces thereof which are eccentrically disposed with reference to the central axis of the base, and the caps are adjustable rotatably on the ends of the drainage line pipes so that the positions of the face openings can be varied or adjusted within the junction box, and with respect to the level or height of liquid therein.

By appropriate adjustment of these liquid levelling caps, different levels and variations of levels of liquid in the junction box can be accommodated to ensure a substantially equal entry of liquid from the box into all of, or desired ones of, the liquid drainage lines from the junction box, with a resultant optimally efficient distribution of the drained and discharged liquid into the drain field or area in which the septic system is located.

BRIEF DESCRIPTION OF THE DRAWINGS

Additional objects, advantages and purposes of the invention will be more readily apparent from the following detailed description of preferred embodiments thereof when taken together with the accompanying drawings in which.

DETAILED DESCRIPTION OF PREFERRED EMBODIMENTS

Figure 1:
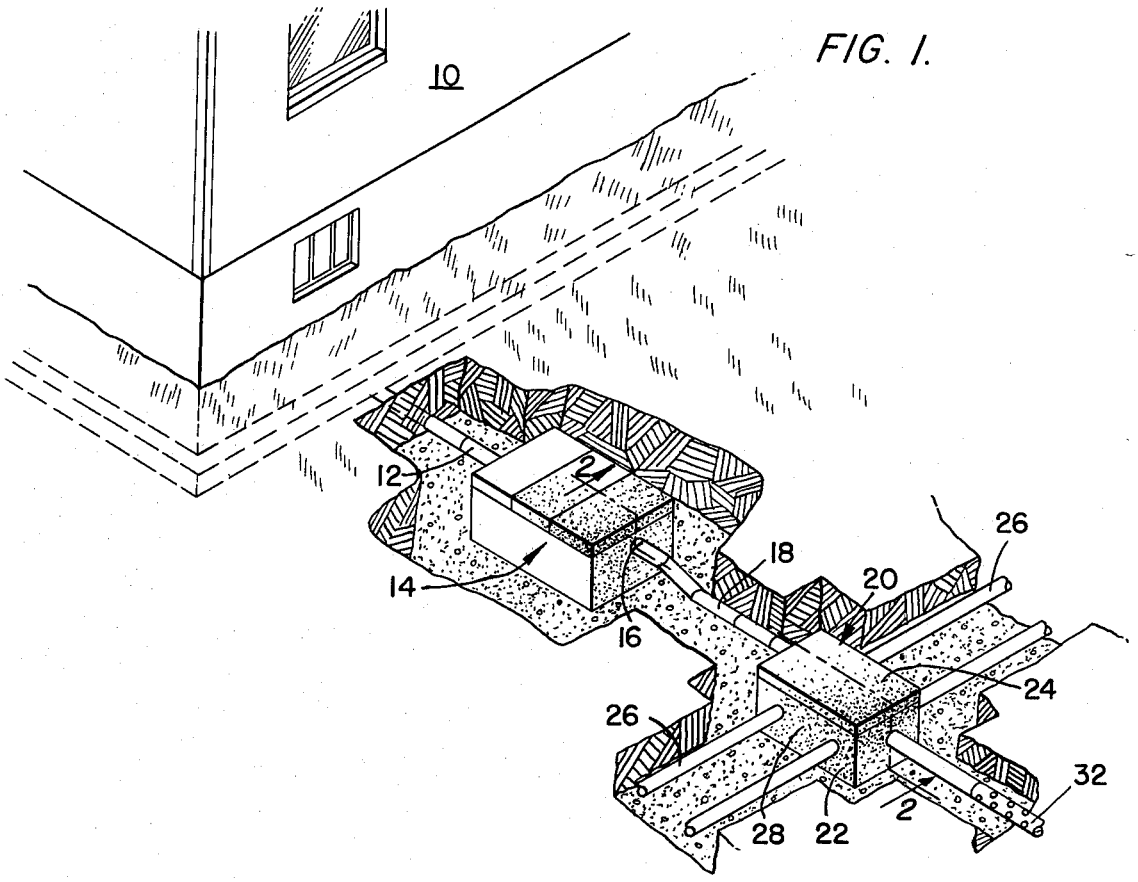
FIG. 1 is a fragmentary perspective overall view of a septic system incorporating the invention, including schematically the principal components of the system.
Figure 2:
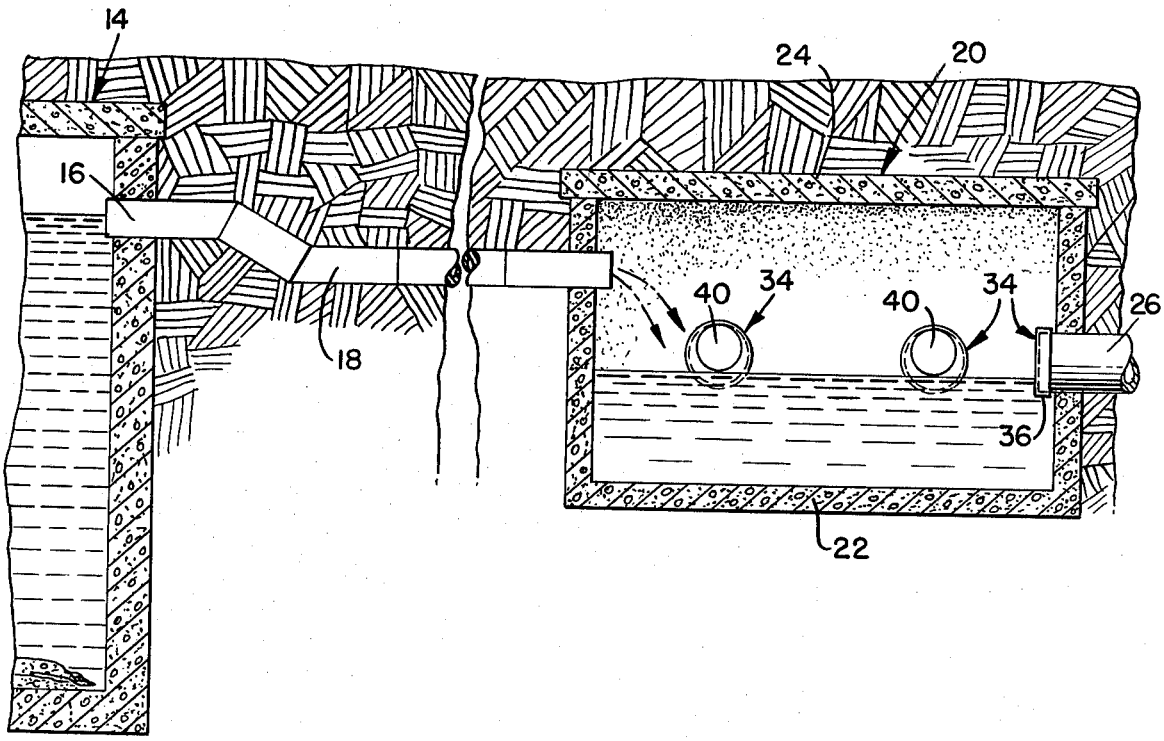
FIG. 2 is an enlarged fragmentary view of a portion of the septic system showing the septic tank and junction box with connecting discharge lines positionally disclosed in this portion of the system.
Figure 3:
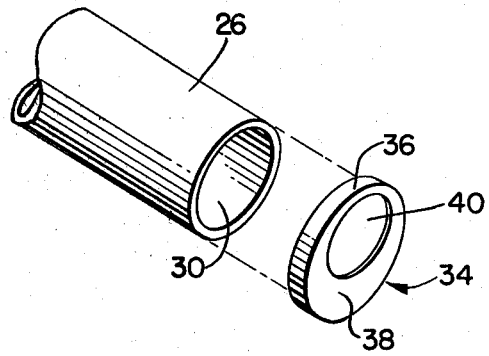
FIG. 3 is an exploded perspective view of one end of a liquid discharge line adapted to be operatively connected into the junction box and disclosing a rotatably adjustable end face cap for the pipe having an eccentrically disposed face entry opening for liquid therein.

As shown in FIG. 1 of the drawings, sewage or waste disposal from a house schematically indicated at 10, or other building, passes therefrom through a waste discharge or disposal piping system 12 from the building in a usual manner, and flows into a septic tank 14 of a usual and known type. Treatment and/or separation of the waste materials including the solids and liquids, takes place partially in this septic tank and under normal operating circumstances the liquid material will rise to the top of the waste material contents in the septic tank and to a point of entry at 16 into a discharge line 18 therefrom. Normally the tank, and lines entering into and discharging outwardly therefrom, are buried in the ground outside of the building. The liquid or water discharged from the septic tank through pipe 18 is discharged into a junction box, generally designated 20, which can be in the nature of a waste liquid distribution box and can be of a normal usual construction, including an open-topped box 22 having a removable lid or top 24 thereon.

As shown in FIG. 1, a plurality of liquid discharge pipes or lines 26 which can, for example, consist of solid polyvinyl chloride piping enter through the side walls 26 of the junction box. These pipes or discharge lines have their open ends 30 openly disposed to the interior of the junction box, and are adapted for entry of liquid thereinto for passage through the liquid discharge lines to a drainage field surrounding the system, and which can include in a known manner drain field pipes or lines 32 disposed and operable to discharge from openings therein, or from end spaced sections thereof, the liquid or water discharged from the junction of distribution box 20 for absorption in the ground, and/or evaporation into the surrounding atmosphere, after passage through the septic system treatment.

Under some circumstances, the liquid levels in junction boxes can vary, for reasons such as faulty installation, and/or geographical or terrain location conditions, and can result in variations in the liquid level within the junction box at different interior locations. In other circumstances it is conceivable that the geological nature of a surrounding drainage field will provide for different degrees or amounts of liquid absorption. Under any such circumstances it is desirable, and the present invention provides for, an adjustment of the inlet end openings 30 of discharge lines 26 to accommodate and compensate for such variations. To this end, the present invention teaches the use of liquid levelling caps rotatably and adjustably mounted over the ends of the inlet ends 30. These caps 34 can be constructed of any appropriate material, and include flanges 36 and closure end faces 38. The interior diameter, or dimensions, and configuration of the flange 36 permits mounting thereof on the exterior of the liquid discharge lines or pipes 26. The dimensions are such as to cause a tight or frictional engagement of the cap on the pipe, and at the same time permit rotation of the cap on and with respect to the pipe.

The closure end face 38 is provided with a liquid inlet hole or opening 40 therethrough and this opening or hole is offset or eccentrically disposed with respect to the center or central axes of the cap 34 and pipe 26. Preferably one of these caps is mounted on the inlet end of each of the pipes entering into the junction box.

Figure 4:
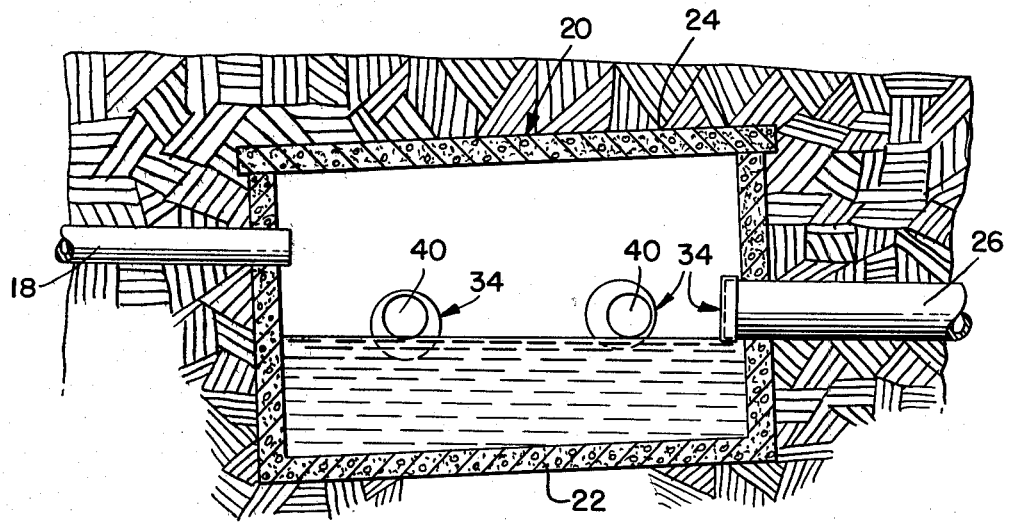
FIG. 4 is a fragmentary view similar to FIG. 2, but disclosing a positionally sloping junction box, and with the liquid entry holes or openings in the end faces of the discharge lines being adjusted to accommodate the liquid level in the sloped junction box.
Figure 5A:
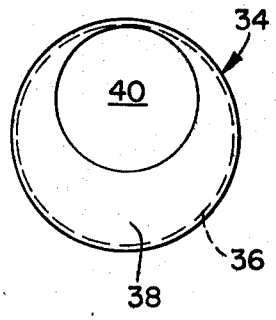
FIGS. 5A, 5B and 5C are schematic end elevation, or cross-sectional views, of a liquid discharge line end cap disclosing different radially adjusted positions of the inlet opening to accommodate different operating conditions and circumstances.
Figure 5B:
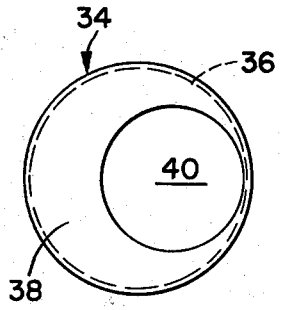
Figure 5C:
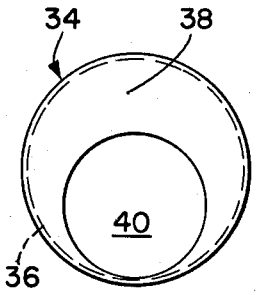

Operationally, referring to FIGS. 5A, 5B and 5C, the levelling caps can be so rotated as to dispose the individual openings 40 therethrough at different positions on the pipes, and accordingly at different variable adjusted dispositions or elevations within the junction box. This variation in disposition of course varies the inlet opening into the liquid discharge lines 26 and can serve several functions. Basically, however, the adjustment of the caps and accordingly the inlet openings will serve to permit equal flow or even distribution of liquid from the junction box into the drain lines. The levelling caps can also accommodate for an installation such as shown in FIG. 4 of a canted juncture box disposition or mounting. Even though the juncture box, due to installation or terrain, etcetera, is sloped, the caps can be adjusted according to the liquid level in the junction box, and thereby adjust for substantially equal entry into and flow through the various drainage lines.

As hereinbefore pointed out, the adjustment of the caps can also be utilized to control the liquid discharge into, and flow through, the various lines 26 to accommodate for varying terrain and geological conditions encountered where the septic system is installed. Different water levels can be accommodated to the individual drain lines by rotation and adjustment of the end caps, and a desired and/or even distribution of the liquid into the drain lines can thereby be achieved.

Manifestly, changes in details of structure can be incorporated in the invention without departing from the spirit and scope thereof as defined in, and limited solely by, the appended claims.

I claim:

1. A septic tank system comprising a septic tank, a junction box operatively connected to receive liquid from the septic tank, and discharge means operatively connected into said junction box for discharging liquid from the junction box into a septic drain field, said discharge means including an open ended pipe having an end extending into said junction box to receive and discharge liquid therefrom, a cap member mounted on said end being located in said junction box, said cap member including an end closure face having an opening eccentrically offset from the axial center of the pipe and a flange extending from said end clousre face, said flange having an internal dimension for rotatably securing the cap to the open ended pipe, said cap member being rotatably secured to the pipe to variably position said opening with respect to the surface level of a liquid in said junction box, thereby controlling the liquid discharge flow into the drain field.

2. In a septic tank system as claimed in claim 1, wherein said open ended pipe is cylindrical, said cap member has a circular cross-section and a cylindrical shaped flange.

3. In a septic tank system having a septic tank, a junction box operatively interconnected to the septic tank to receive discharge material from the septic tank, and a plurality of discharge pipes operatively connected to the junction box for discharge of liquid therefrom and distribution into a septic drain field, each of said pipes having an end with an opening extending through a side wall of said junction box to receive liquid therefrom; the improvement comprising a cap rotatably mounted on at least one open end, said cap having a pipe mounting flange and an end closure face, said end closure face having an opening eccentrically offset from the axial center of the pipes and being rotatably secured to the pipe, rotation of said cap serving to variably position the cap opening with respect to the surface level of a liquid in said junction box, thereby controlling the liquid discharge flow into the drain field.

4. A septic tank system as claimed in claim 1 or 3, wherein a plurality of said open ended pipes extend into said junction box at peripherally spaced positions, each of said open ended pipes having a said cap member rotatably mounted thereon, said cap members being separately individually adjustable to vary the inlet opening of any of the discharge pipes with respect to liquid level in said junction box, enabling even or controlled distribution of discharge liquid into the drain field.

* * * * *